United States Patent [19]

Martin

[11] Patent Number: 4,988,986

[45] Date of Patent: Jan. 29, 1991

[54] DISPLAY MODULE AND MULTIPLE UNIT DISPLAY CONSTRUCTED OF SUCH DISPLAY MODULES

[75] Inventor: Adolf H. Martin, Glenview, Ill.

[73] Assignee: Inventio AG, Hergiswil, Switzerland

[21] Appl. No.: 288,195

[22] Filed: Dec. 22, 1988

[51] Int. Cl.[5] ..... G08B 5/00; G08B 5/36

[52] U.S. Cl. ..... 340/815.01; 340/815.14; 340/815.15; 340/815.2

[58] Field of Search ..... 340/815.01, 815.02, 340/815.1, 815.12, 815.14, 815.15, 815.16, 815.2, 815.21, 815.23, 815.27, 700; 40/541, 550, 564; 362/76, 226, 227, 249, 362, 367, 368; 315/51

[56] References Cited

U.S. PATENT DOCUMENTS

| | | | |
|---|---|---|---|
| 1,108,999 | 9/1914 | Levison . | |
| 1,878,872 | 9/1932 | Lucas . | |
| 1,879,801 | 9/1932 | Graham et al. . | |
| 2,925,592 | 2/1960 | Noyes . | |
| 3,080,554 | 3/1963 | Jacobel, Jr. et al. . | |
| 3,194,954 | 7/1965 | Locke | 40/564 |
| 3,268,889 | 8/1966 | Ast | 340/815.1 |
| 3,742,446 | 1/1973 | Wells et al. | 340/815.12 |
| 3,903,458 | 9/1975 | Arnoux | 340/815.14 |
| 4,471,350 | 9/1984 | Chow | 340/815.2 |
| 4,504,713 | 3/1985 | Hennessey . | |
| 4,723,119 | 2/1988 | Morimoto | 340/815.1 |
| 4,820,956 | 4/1989 | Slobodzian et al. | 340/815.2 |
| 4,901,155 | 2/1990 | Hara et al. | 340/815.27 |

FOREIGN PATENT DOCUMENTS

| | | |
|---|---|---|
| 7685 | 5/1928 | Australia . |
| 2854469 | 7/1980 | Fed. Rep. of Germany . |
| 2914525 | 7/1980 | Fed. Rep. of Germany . |
| 802730 | 9/1936 | France . |
| 465230 | 5/1937 | United Kingdom . |

OTHER PUBLICATIONS

W. L. Larrabee; "Quick Mounting Light Receptacle"; IBM Technical Disclosure Bulletin; vol. 1 No. 5 Feb./1959, p. 9.

*Primary Examiner*—Alvin E. Oberley
*Assistant Examiner*—M. Fatahi-yar
*Attorney, Agent, or Firm*—D. R. Lackey

[57] ABSTRACT

A display module having a housing constructed to mechanically interlock with the housings of adjacent modules of like construction to form a multiple unit display having either a single display row, or a cluster having first and second display rows. The modules of a display row interlock via male and female dove tail extrusions integrally formed with the module housings, while modules of adjacent first and second display rows interlock via cooperative projections and recesses integrally formed with the module housings and via a common electrical conductor which mechanically and electrically interconnects electrical terminals of adjacent display rows to hold the first and second display rows in assembled relation while simplifying electrical connections to the cluster. A single mounting projection per housing provides support for mounting a row or cluster to a face plate, by selection of predetermined orientations of the modules.

10 Claims, 6 Drawing Sheets

DISPLAY MODULE AND MULTIPLE UNIT DISPLAY CONSTRUCTED OF SUCH DISPLAY MODULES

TECHNICAL FIELD

The invention relates in general to displays, and more specifically to indicator light units of the modular type which may be used to construct multiple unit displays, such as an elevator car position indicator for an elevator system.

BACKGROUND ART

Modular type indicator light units of the prior art are constructed of a large number of components, making manufacture and assembly time consuming and costly. It would be desirable and it is the object of the present invention to provide a new and improved modular type indicator light or display module having a relatively few easily assembled components. It is a further object of the invention to provide display modules which may be quickly and easily assembled with like display modules to form a multiple unit display or indicator.

DISCLOSURE OF THE INVENTION

Briefly, the present invention is a new and improved display module or lamp indicator unit comprising a molded plastic housing having integrally formed male and female extrusions which respectively cooperate with female and male extrusions of adjacent modules to enable a plurality of modules to be interconnected without tools. A light bulb is inserted into the molded housing from the rear of the housing, and replaced from the rear, without tools, facilitating bulb servicing. Electrical wiring is also easily accessible from the rear of the housing. Each housing has an open side, providing good ventilation, with the module interconnection patterns always orienting the open side up or down, and never adjacent to another module. A single mounting projection per housing is oriented to provide panel support for a row, or a cluster formed of first and second rows. When a multiple unit display or indicator requires only a single row of modules, alternate modules are inverted to alternate the mounting projection between the top and bottom of the row. When a multiple unit display is a cluster having two rows, the modules of each row have a like orientation, with a whole row being inverted to locate mounting projections along the top and bottom of the cluster. A single panel opening and a single lens may be used for a single row, or for a cluster, eliminating the need to punch a plurality of openings in a panel, one for each module, as is common in the prior art.

BRIEF DESCRIPTION OF THE DRAWINGS

The invention will become more apparent by reading the following detailed description in conjunction with the drawings, which are shown by way of example only, wherein.

DESCRIPTION OF PREFERRED EMBODIMENTS

Figure 1:
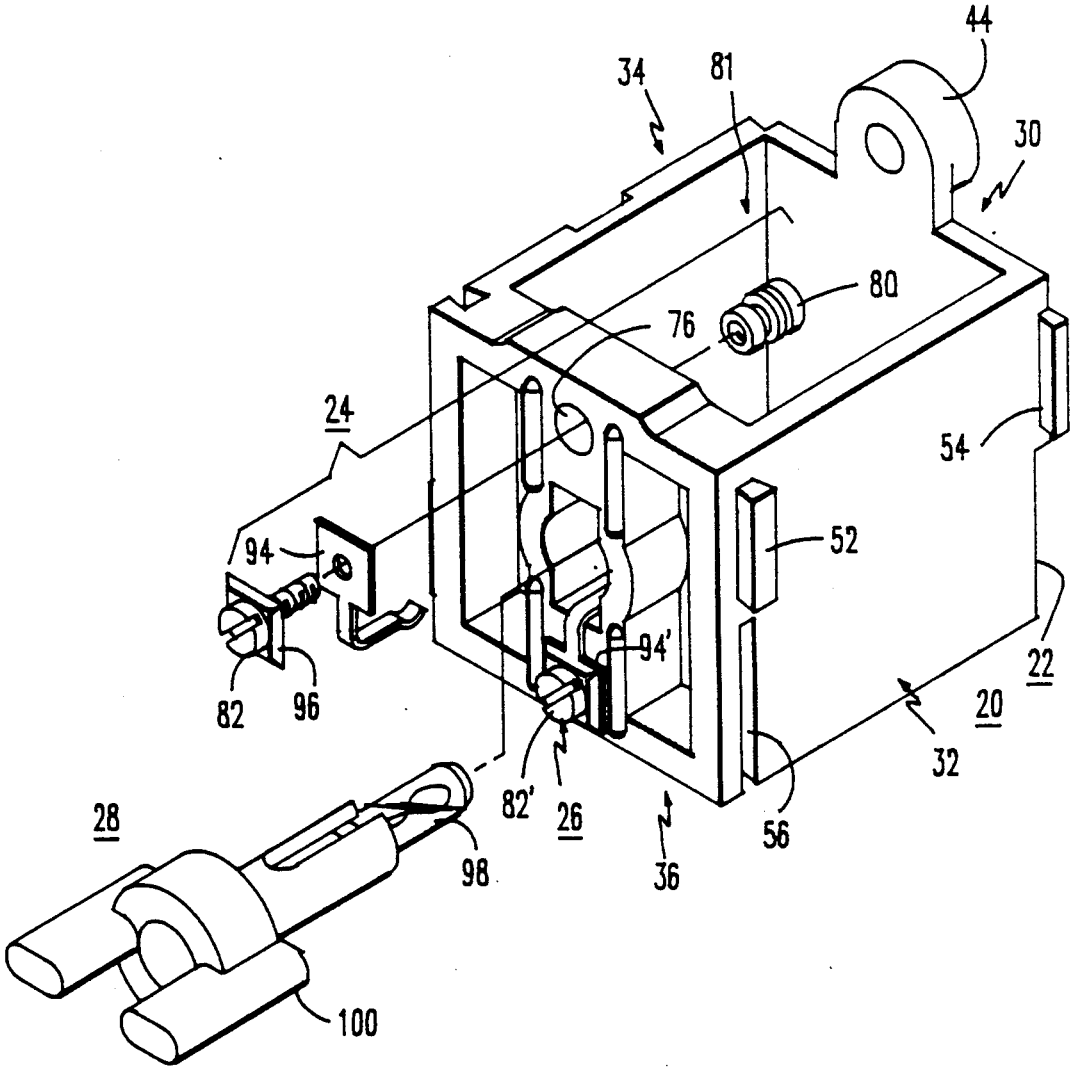
FIG. 1 is a partially exploded perspective view of a display module or lamp indicator unit constructed according to the teachings of the invention.

Referring now to the drawings, FIG. 1 is a partially exploded perspective view of a display module or lamp indicator unit 20 constructed according to the teachings of the invention. Module 20 includes a one-piece housing 22, molded from a high strength translucent plastic material, such as a polycarbonate. The only additional components required are first and second wiring and lamp contact structures 24 and 26, respectively, and a lamp module 28. The wiring and contact structures 24 and 26 and lamp module 28 may be the same as shown and described in U.S. Pat. No. 4,504,713, which is assigned to the same assignee as the present application, and this patent is hereby incorporated into the specification of the present application by reference.

Figure 6:
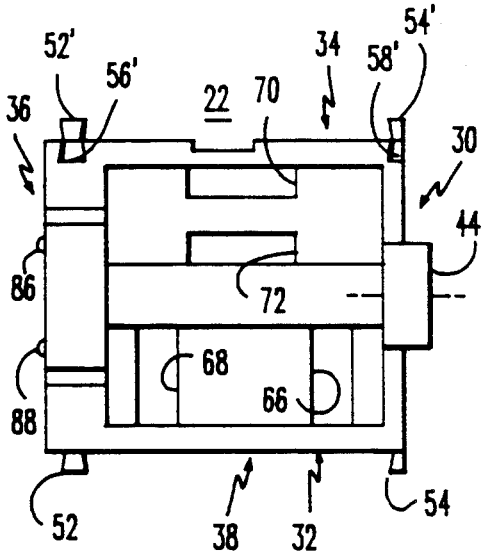
FIG. 6 is a plan view of the housing shown in FIG. 2.
Figure 7:
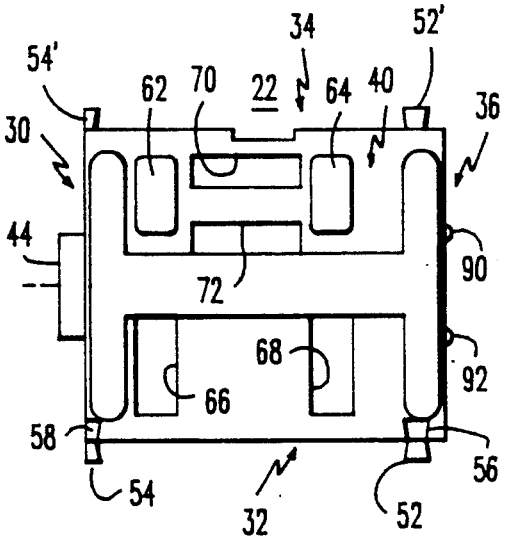
FIG. 7 is a bottom view of the housing shown in FIG. 2.
Figure 8:
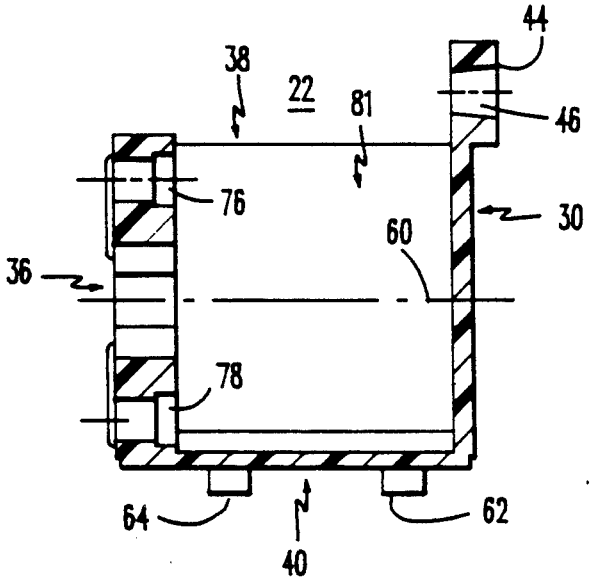
FIG. 8 is a sectional view of the housing shown in FIG. 2, taken between and in the direction of arrows VIII—VIII.

Housing 22 is shown in detail in FIGS. 2 through 8, with FIGS. 2, 3, 4 and 5 being elevational views of a front portion 30, a first or left side 32 in the orientation shown, a second or right side 34, and a rear 36 portion, respectively. FIGS. 6 and 7 illustrate top and bottoms 38 and 40, respectively. FIG. 8 is a cross sectional view of housing 22 taken between and in the direction of arrows VIII—VIII in FIG. 2. As will be hereinafter explained, housing 22 may be inverted from the orientation shown, and thus the top 38 and bottom 40 of FIGS. 6 and 7 refer to the orientation of housing 22 shown in FIG. 2. In an inverted orientation of housing 22, reference 38 would refer to a bottom side and reference 40 would refer to a top side.

Figure 2:
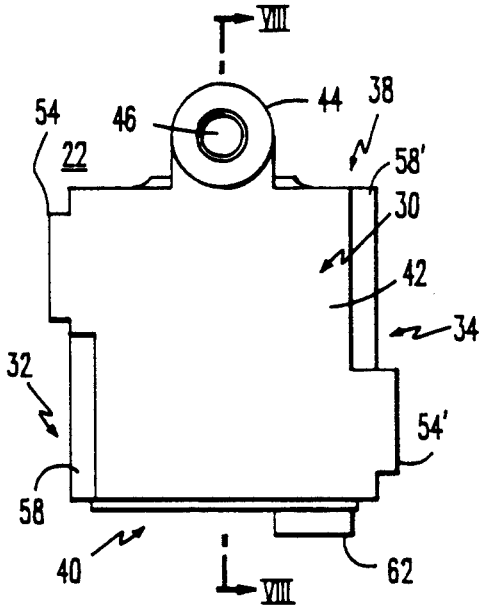
FIG. 2 is a front view of a molded housing of the display module or lamp indicator unit shown in FIG. 1.
Figure 5:
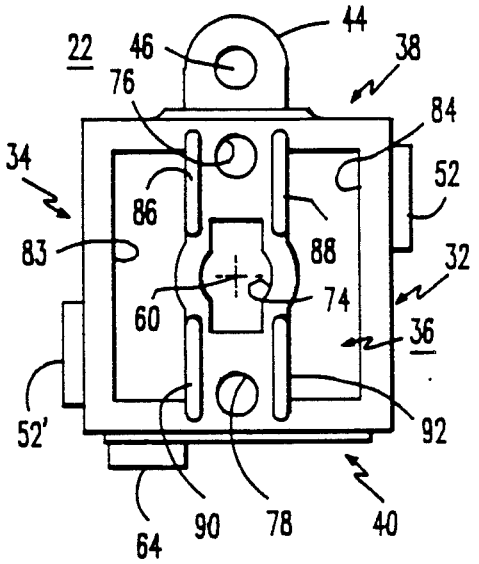
FIG. 5 is a rear view of the housing shown in FIG. 2.

As shown in FIG. 2, front side 30 of housing 22 includes a major flat front surface 42 which is substantially square in configuration. Surface 42 is aligned with the like front surfaces of other display modules in multi-unit displays. Also clearly shown in FIG. 2 is a mounting projection 44 which extends outwardly from top 38. Mounting projection 44 has an opening 46 having a central axis 47. Opening 46 is adapted to receive a mounting stud attached to a face plate, such as mounting stud 48 shown fixed to a face plate 50 in FIG. 11, which will be hereinafter described in detail.

Each housing 22 has a single mounting projection 44, with the housings 22 being oriented in multi-unit displays such that mounting projections 44 are disposed on opposite sides of the display for firm support to a face plate, such as face plate 50.

Figure 3:
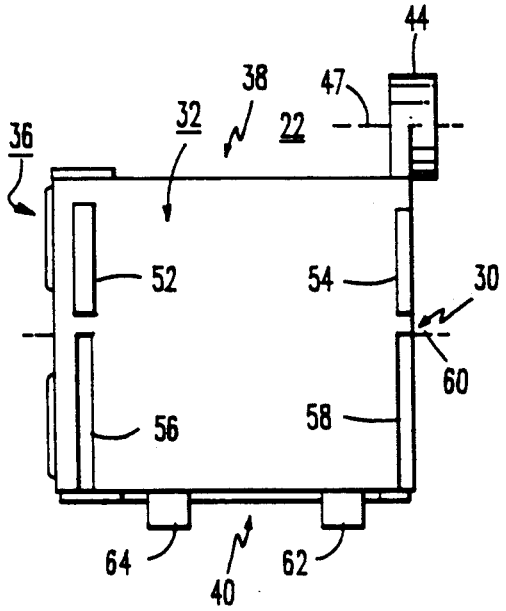
FIG. 3 is a left hand elevation of the housing shown in FIG. 2.
Figure 4:
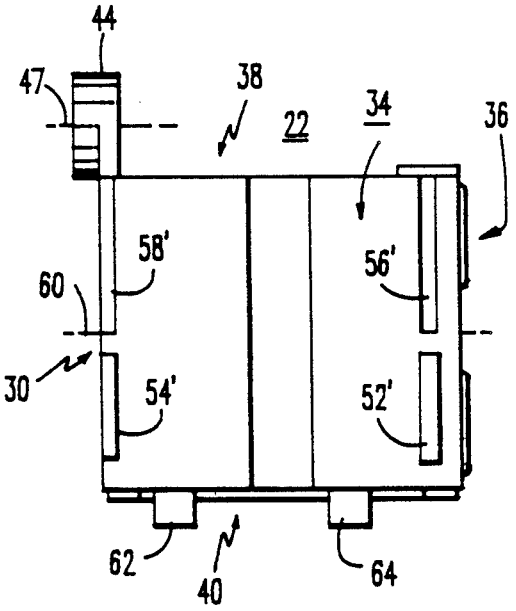
FIG. 4 is right hand elevation of the housing shown in FIG. 2.

FIGS. 3 and 4 illustrate the first and second sides 32 and 34, respectively, which contain male and female dovetail extrusions for quickly joining adjacent housings. The first side 32 includes first and second male extrusions, projections or outward extensions 52 and 54, respectively, and first and second female extrusions, recesses or grooves 56 and 58, respectively. Male extension 52 starts near top 38 and runs about one-third of the way towards bottom 40, in closely spaced parallel relation with rear 36. The female groove 56 starts at, or closely adjacent to, the termination of male extension 52 and continues in the same direction as the male extension until reaching bottom 40. As best shown in FIGS. 6 and 7, male extension 52 has dove-tail shaped cross section, expanding outwardly on both sides at an angle of about 10 degrees. Female groove 56 has a complementary dove tail shape for receiving the dove tail configuration of male extension 52. Male projection 54 has one side aligned with front surface 42, and as shown in FIGS. 6 and 7, only the side of projection 54 which is opposite to front surface 42 has a ten degree expansion. In like manner, female recess 58 also intersects the front surface 42, and as shown in FIG. 7 it has one side sloped at the 10 degree angle, as it is open on the side which intersects front surface 42.

The second side 34 includes first and second male extrusions, projections or extensions 52' and 54', and first and second female extrusions, recesses or grooves 56' and 58'. The male and female extrusions on the second side 34 are given the same reference numerals as those on the first side 32, except for a prime mark, as the like numbered male and female extrusions are in 180 degree rotational symmetry about a longitudinal axis 60. Axis 60 is parallel with axis 47 associated with opening 46 which receives a mounting stud 48.

When housing 22 is rotated 180 degrees about axis 60 male extrusion 52 will move into the exact position formerly occupied by male extrusion 52', and male extrusion 52' will move into the exact position formerly occupied by male extrusion 52. The same is true for the remaining male and female extrusions on sides 32 and 34 of housing 22, and thus adjacent housings may be interlocked by joining side 34 with side 32, with both modules having the same orientation; and, adjacent housings may be interlocked by joining side 34 with side 34, or side 32 with side 32, with one module being inverted or rotated 180 degrees about axis 60 relative to the orientation of the other module.

As best shown in FIGS. 3, 4, 7 and 8, bottom 40 has first and second male projections 62 and 64 disposed in spaced relation in a direction from the front 30 to the back 36. They are disposed on a side of central axis 60 which is adjacent to side 34 of housing 22. In like locations on the other side of central axis 60, i.e., adjacent to side 32, bottom 40 defines first and second recesses or openings 66 and 68, which openings are sized to snugly receive male projections 62 and 64, respectively, when the bottoms 40 of two housings 22 are placed in contacting relation. Openings 70 and 72 in bottom 40 are for ventilation.

Thus, sides 32 are joined to sides 34 to create a row of like oriented modules, and this row may be placed upon a second row of like oriented modules, to form a cluster of modules, by inverting one row relative to the other, with the male projections 62 and 64 cooperating with openings 66 and 68 to help interlock vertically adjacent rows of the cluster.

Top 38, as best shown in FIGS. 6 and 8, is completely open for superior ventilation, with top 38 being defined by the ends of front portion 30, rear portion 36 and the first and second sides 32 and 34.

Rear 36 portion, as best shown in FIGS. 4 and 8, defines a central opening 74 for receiving lamp module 28, and first and second openings 76 and 78 for receiving threaded bushings, such as bushing 80 shown in FIG. 1. As shown in FIG. 8, openings 76 and 78 are stepped, having a smaller diameter adjacent to the outer surface of rear 36, and bushings 80 are stepped. Bushings 80 are pressed into openings 76 and 78 from within the cavity 81 defined by the front 30, rear 36, sides 32 and 34 and bottom 40, so they cannot pull out when threadably engaged by a screw, such as screw 82 shown in FIG. 1. Openings 83 and 84 in rear 36 aid ventilation. Raised portions 86, 88, 90 and 92 provide locating guides for lamp engaging contacts 94 and 94' shown in FIG. 1.

Returning to FIG. 1, the first and second wiring and lamp contact assemblies 24 and 26 are of like construction, and thus only the first assembly 24 will be described. Like components of the second assembly 26 are given like reference numerals with a prime mark. The first assembly 24 includes threaded bushing 80, which is fixed in opening 76, lamp engaging contact 94, and screw 82 which fixes contact 94 in the proper location, aided by guides 86 and 88. Screw 82 also has a captured square washer 96 which provides room for a wire when screw 82 is not tightened, to facilitate wiring of the lamp contacts. Thus, screw 82 provides the dual function of securing a lamp engaging contact 94 and an electrical wire for energizing the contact.

Lamp module 28 includes a lamp 98 and a lamp holder 100, with lamp 98 being energized by contacts 94 and 94' simply by pushing the lamp 98 and lamp holder 100 into opening 74 in rear 36 of housing 22. Thus, lamp 98, which enters cavity 81 in its operative position, is easily replaced, without tools, simply by pulling lamp holder 100 from the rear of housing 22. Heat generated by lamp 98 is quickly dissipated by the open construction of housing 22, with the open top 34 remaining unobstructed in any multiple unit configuration of the modules 20.

Figure 11:
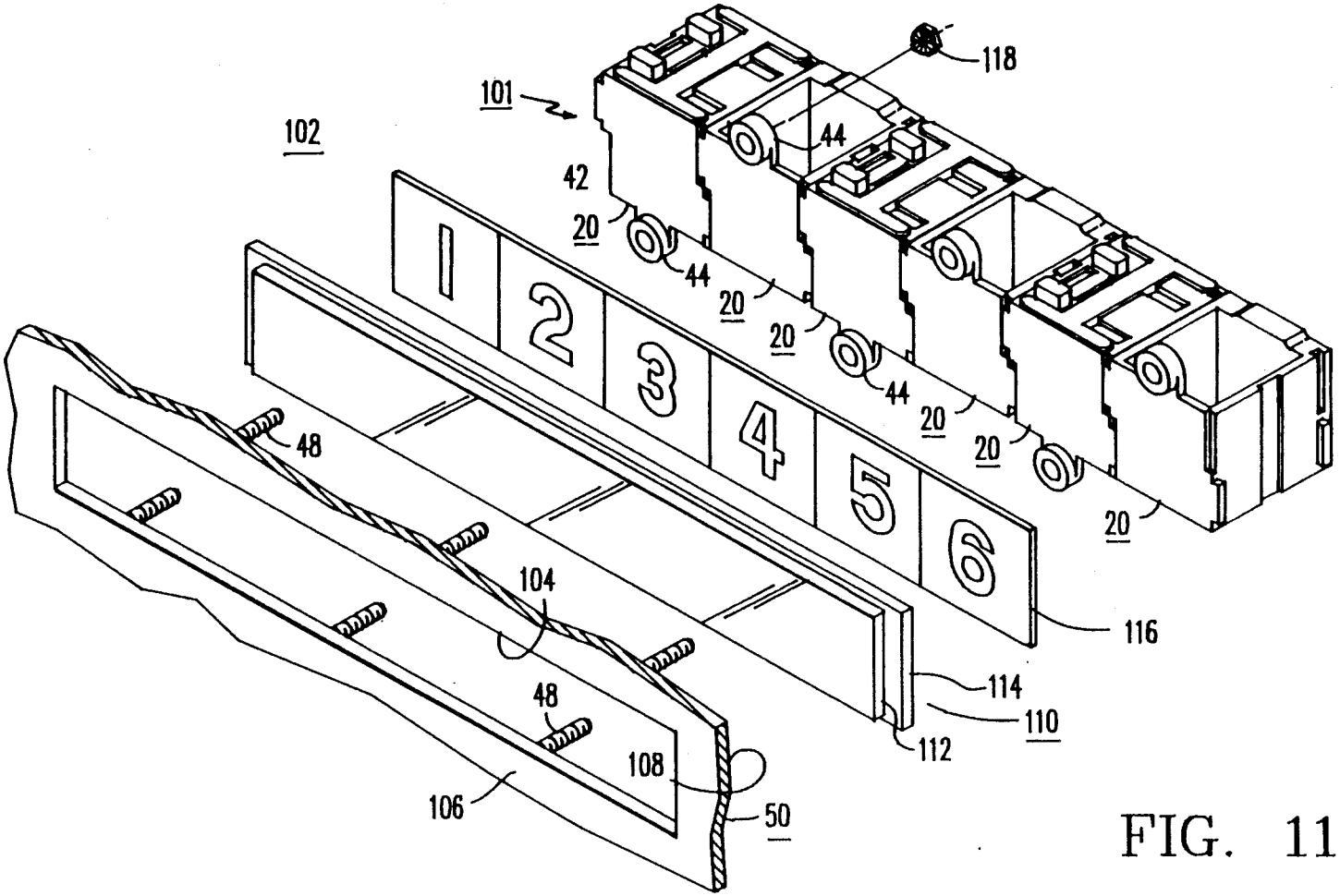
FIG. 11 is an exploded perspective view of the multiple unit display shown in FIGS. 9 and 10.
Figure 10:
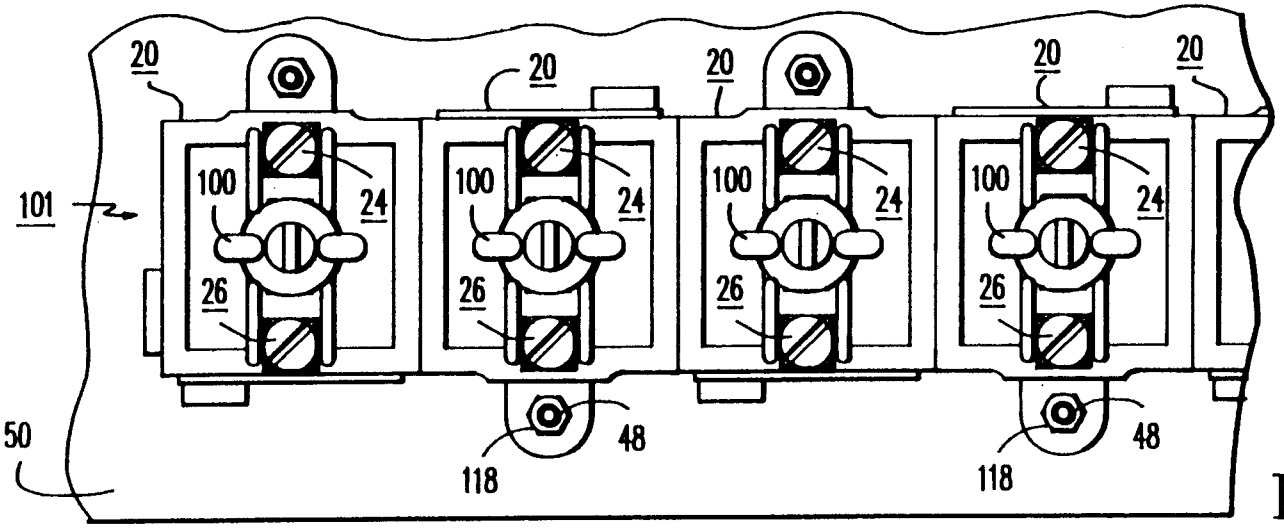
FIG. 10 is a rear view of the multiple unit display shown in FIG. 9.
Figure 9:
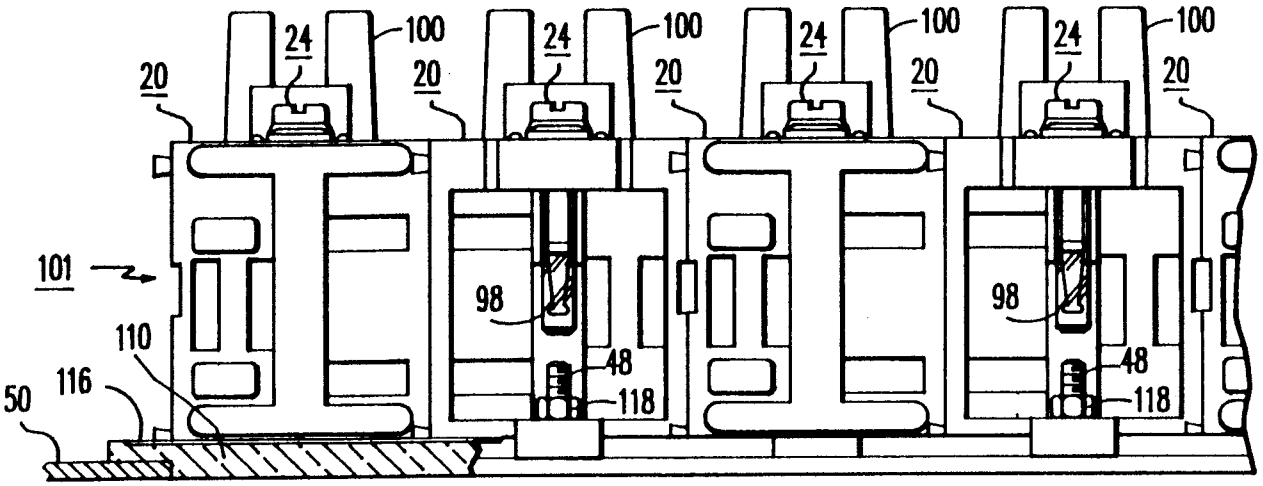
FIG. 9 is a plan view of a multiple unit display having a single row constructed of a plurality of the display modules, shown in FIG. 1.

FIGS. 9, 10 and 11 illustrate a first multiple unit embodiment of the invention, in which modules 20 are assembled in a bar, serial string or row 101 to form a display or indicator 102. FIG. 9 is a plan view of display 102, FIG. 10 is a rear view, and FIG. 11 is an exploded perspective view. With a single row of modules 20, alternate modules are inverted to place mounting projections 44 on both the top and bottom of the row for firm support of the row in face plate 50. To form row 101, if the first module at the left hand end is to have mounting projection 44 on the bottom of the row, side 32 is engaged with side 32 of the next adjacent module by aligning male extrusion 52 of the second module with female extrusion 56 of the first module, and by aligning male extrusion 54 of the second module with the female extrusion 58 of the first module, and then pushing the two modules together until the top and bottom edges are aligned. The third module from the left is inverted and its side 34 is engaged with side 34 of the second module by engaging male extrusion 52' with female extrusion 56', and by engaging male extrusion 54' with female extrusion 58'. Any number of modules 20 may be joined in this manner. Of course, it is not necessary to invert alternate modules, with any pattern of mounting projections being suitable as long as adequate support is provided for row 101 on face plate 50.

Display 102 simulates a digital display, and it is not necessary or even desirable to punch an opening in face plate 50 for each digit. An aesthetic display is provided, according to the teachings of the invention by providing a single opening 104 in face plate 50 in a rectangular configuration with corresponds to the length of row 101. Face plate 50 may be formed of any suitable material, such as stainless steel, brass, and the like, and it may be a separate component for mounting above an elevator hatch door, or it may be part of a panel or wall, as desired, according to the function display 102 is to provide. Face plate 50 has outer and inner sides 106 and 108, with a plurality of studs 48 being fixed to the inner side 108. When face plate 50 is formed of metal, studs 48 may be stud welded to inner surface 108.

A dark translucent plastic lens 110, such as red, for example, is provided which has a projection 112 sized to snugly enter opening 104 in face plate 50, and a flange 114. The depth of projection 112 is selected to match the thickness of face plate 50, to enable flange 114 to be pressed tightly against inner surface 108.

Indicia to be selectively illuminated by modules 20 may be provided by a thin indicia bearing member 116 having the desired indicia in the form of openings in member 116; or, in the form of light transmissive numbers or letters surrounded by opaque material, such as a negative-like black plastic. Alternatively, instead of a separate indicia bearing member 116, the front surfaces 42 of each module 20 may be painted a dark color, such as black, except for the configuration of the indicia. The indicia may be formed by masking during the painting process, or by engraving surface 42 after the paint has dried. Nuts 118 are threadably engaged with studs 48 to hold the lens 110, indicia bearing member 116 and row 101 of modules 20 in assembled relation.

Figure 13:
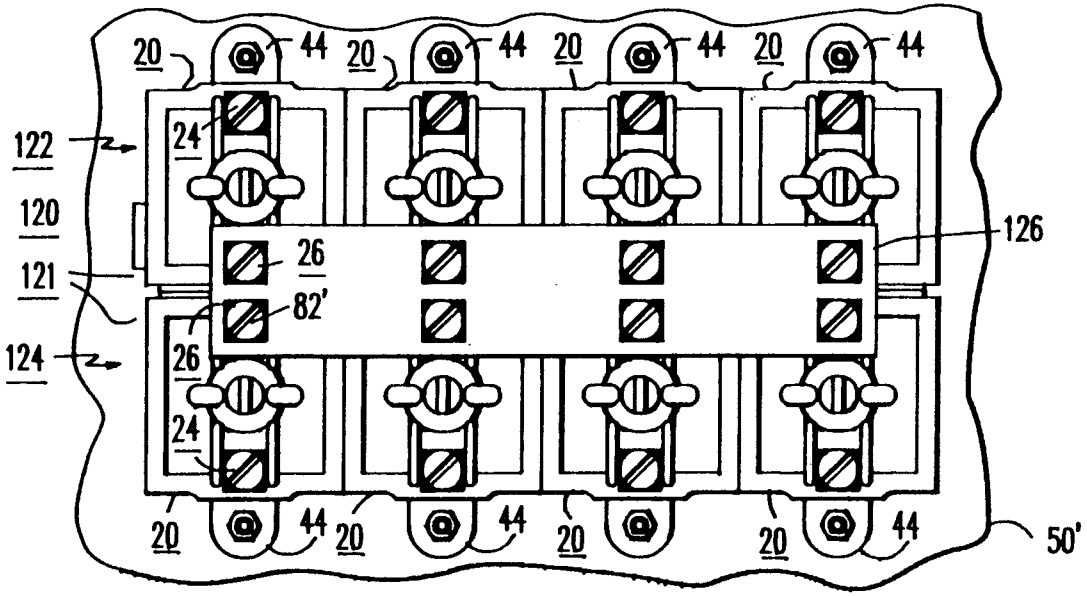
FIG. 13 is a rear view of the multiple unit display shown in FIG. 12.
Figure 12:
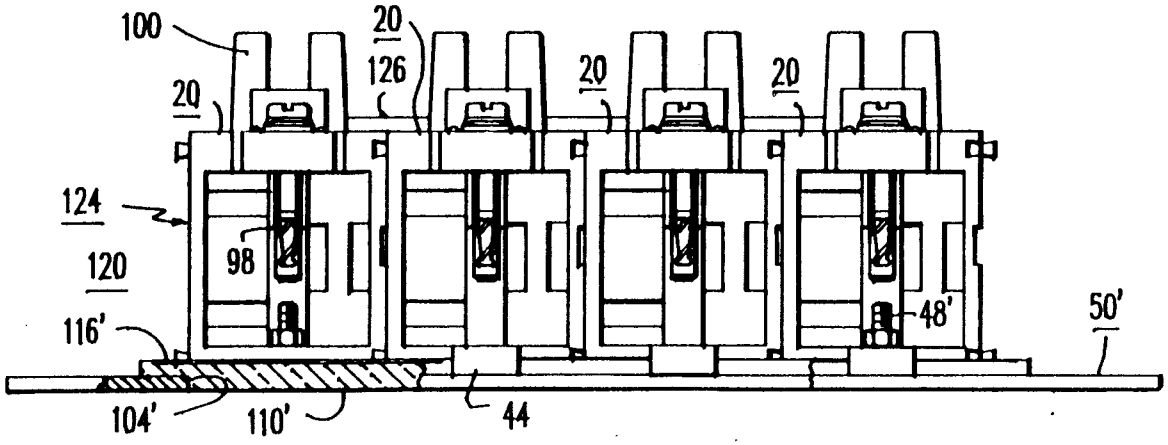
FIG. 12 is a plan view of a multiple unit display having a double row or cluster of the display modules shown in FIG. 1.

FIGS. 12 and 13 illustrate a multiple unit display 120 constructed according to another embodiment of the invention in which modules 20 are arranged in a cluster 121 having first and second superposed rows 122 and 124, respectively. When two rows are utilized all of the modules 20 of each row are assembled with a like orientation in which mounting projections 44 are all disposed on the same side of the row. Then one row is inverted relative to the other row and placed with their sides 40 in contact such that projections 62 and 64 of each module enter openings 66 and 68 of the other module. This places mounting projections 44 above and below cluster 121 for firm mounting support via studs 48' of a face plate 50' The open tops 38 of the modules 20 in the first or upper row 122 face upwardly, and the open tops 38 of the modules 20 in the second or lower row 124 face downwardly, free of any obstruction, which, along with the large openings 83 and 84 in back 36 of housing 22, provide excellent ventilation for cluster 121.

Similar to display 102 of the first multiple unit embodiment, face plate 50' may include a single opening 104' for receiving a lens 110'. An indicia bearing member 116' may be provided, or the indicia may be formed on the major front surfaces 42 of the module housings 22, as hereinbefore described.

Additional mechanical support for holding the first and second rows 122 and 124 together may be provided by a thin electrically conductive member 126, such as a rectangular copper sheet, having a plurality of openings formed therein in a pattern which matches the locations of openings 78 in the housings 22 of the modules 20 which form cluster 121. Thus, after lamp terminals 94' are positioned on rows 122 and 124 of cluster 121, electrically conductive member 126 is positioned with its openings aligned with openings 78 of the housings 22, and then screws 82' are engaged with bushings 80' disposed in openings 78. Electrical conductor 126 forms the common return line for the plurality of lamps 98 associated with cluster 121, requiring only one wire to be connected to any one of the screws 82', greatly simplifying the wiring of the cluster, while providing additional mechanical support.

In summary, there has been disclosed a new and improved display module or lamp indicator unit 20 having a housing 22 molded of a translucent plastic which may be assembled with like modules and a face plate to form a row or cluster, without any tools other than a screw driver and a nut driver. Easy access is provided to the electrical wiring, and lamp bulbs are easily replaced. The multiple unit embodiments only require a single opening, regardless of the number of modules in the display or indicator. Thus, in an elevator position indicator, for example, one number would be illuminated somewhere on the surface of the otherwise dark lens.

I claim:

1. A display module which may be assembled and interlocked with like modules to provide a multiple unit display having either a single or a double row of modules, comprising:

a housing having first and second spaced parallel sides, a third side interconnecting said first and second sides, a front portion defining a translucent face member for illuminating indicia, and a rear portion defining an opening having an axis normal to the translucent face member, said housing defining a central cavity having an open end cooperatively defined by predetermined edges of said first and second sides, and said front and rear portions, lamp contacts disposed in the opening of said rear portion to define a lamp socket, first and second electrical terminals carried by the rear portion which are adapted to energize said lamp contacts, a lamp module removably disposed in said lamp socket, said lamp module including a lamp which projects into the cavity, said first and second sides each having male and female dovetail extrusions located such that the male and female extrusions on said first side are in 180 degree rotational symmetry with the male and female extrusions on said second side, enabling male and female extrusions of a module to respectively cooperate with female and male extrusions of an adjacent module, regardless of whether the open end of the cavity of the module faces in the same direction as the open end of a cavity of an adjacent module, or in the opposite direction, and a single mounting projection integral with said housing defining a stud receiving opening having an axis parallel with the axis of the opening defined by said rear portion, with said mounting projection extending integrally outward from the front via the edge which cooperatively defines the open end of the cavity.

2. The display module of claim 1 wherein the first and second sides each include a projection and a recess located such that the projection and recess on said first side are in 180 degree rotational symmetry with the projection and recess on said second side, enabling a projection and a recess of the module to respectively cooperate with a recess and a projection of an adjacent module, regardless of whether the open end of the cavity of the module faces in the same direction as the open end of a cavity of an adjacent module, or in the opposite direction.

3. The display module of claim 1 including projections and recesses on the third side of the housing arranged such that they respectively cooperate with recesses and projections on the third side of an adjacent module, when the third side of module is disposed adjacent to the third side of another module.

4. The display module of claim 1 including indicia on the translucent face member.

5. A multiple unit display comprising:

a first display row having a plurality of interlocked first modules of like construction, each of said first modules including a housing having first and second spaced parallel sides, a third side interconnecting said first and second sides, a front portion defining a translucent face member for illuminating indicia, and a rear portion defining an opening having an axis normal to the translucent face member, said housing defining a central cavity having an open end cooperatively defined by predetermined edges of said first and second sides, and said front and rear portions, lamp contacts in the opening of said rear portion which cooperatively define a lamp socket, first and second electrical terminals carried by the rear portion which are adapted to energize said lamp contacts, a lamp module removably disposed in said lamp socket, said lamp module including a lamp which projects into the cavity, said first and second sides each having male and female dovetail extrusions located such that the male and female extrusions on said first side are in 180 degree rotational symmetry with the male and female extrusions on said second side, wherein male and female extrusions of each module respectively cooperate with female and male extrusions of each adjacent module, to interlock the modules of the first row in assembled relation, and a single mounting projection integral with said housing defining a stud receiving opening having an axis parallel with the axis of the opening defined by said rear, with said mounting projection extending integrally outward from the front via the edge which cooperatively defines the open end of the cavity.

6. The multiple unit display of claim 5 wherein the first display row is the sole row of the multiple unit display, and wherein at least certain of the modules of the first row are inverted to dispose module mounting projections on opposite sides of the sole row.

7. The multiple unit display of claim 5 wherein the first modules of the first row are of like orientation, with the mounting projections all being disposed on the same side of the first row, and including a second display row having a plurality of interlocked first modules having the same orientation, with the mounting projections all being disposed on the same side of the second display row, said second display row being disposed immediately adjacent to the first display row with the third sides of the modules of the first display row contacting the third sides of the modules of the second display row, to form a cluster of modules in which the mounting projections of the first display row are disposed on one side of the cluster and the mounting projections of the second display row are disposed on the opposite side of the cluster.

8. The display module of claim 7 including projections and recesses on the third sides of the housings of the first modules of the first and second display rows arranged such that the projections and recesses of the first display row respectively cooperate with recesses and projections of the second display row.

9. The display module of claim 7 wherein second terminals of the first display row are disposed immediately adjacent to second terminals of the second display row, and including electrical conductor means interconnecting the second terminals of the first and second display rows, to facilitate wiring of the cluster and to mechanically interlock the first and second display rows.

10. The display module of claim 5 wherein the first and second sides of each first module include a projection and a recess located such that the projection and recess on said first side are in 180 degree rotational symmetry with the projection and recess on said second side, with the projections and recesses of each of the modules of the first display row respectively cooperating with a recess and a projection of each adjacent module of the first display row, regardless of whether the open end of the cavity of the module faces in the same direction as the open end of a cavity of an adjacent module, or in the opposite direction.

* * * * *